US010878755B2

(12) United States Patent
Li

(10) Patent No.: US 10,878,755 B2
(45) Date of Patent: Dec. 29, 2020

(54) PIXEL COMPENSATING CIRCUIT AND PIXEL COMPENSATING METHOD

(71) Applicant: WUHAN CHINA STAR OPTOELECTRONICS SEMICONDUCTOR DISPLAY TECHNOLOGY CO., LTD., Hubei (CN)

(72) Inventor: Jun Li, Hubei (CN)

( * ) Notice: Subject to any disclaimer, the term of this patent is extended or adjusted under 35 U.S.C. 154(b) by 0 days.

(21) Appl. No.: 16/489,440

(22) PCT Filed: Jan. 17, 2019

(86) PCT No.: PCT/CN2019/072213

§ 371 (c)(1),
(2) Date: Aug. 28, 2019

(87) PCT Pub. No.: WO2020/113790

PCT Pub. Date: Jun. 11, 2020

(65) Prior Publication Data

US 2020/0327853 A1 Oct. 15, 2020

(30) Foreign Application Priority Data

Dec. 6, 2018 (CN) ..... 2018 1 1489457

(51) Int. Cl.
*G09G 5/10* (2006.01)
*G09G 3/3258* (2016.01)

(52) U.S. Cl.
CPC ... *G09G 3/3258* (2013.01); *G09G 2300/0842* (2013.01); *G09G 2310/027* (2013.01); *G09G 2320/045* (2013.01)

(58) Field of Classification Search
CPC ... G09G 2300/0842; G09G 2300/0861; G09G 2320/045; G09G 3/3233
See application file for complete search history.

(56) References Cited

U.S. PATENT DOCUMENTS

2013/0069852 A1 3/2013 Liao
2014/0028270 A1* 1/2014 Miyazaki ..... H02M 3/1588 323/271

(Continued)

FOREIGN PATENT DOCUMENTS

CN 102411893 A 4/2012
CN 103943060 A 7/2014
CN 104091560 A 10/2014

(Continued)

*Primary Examiner* — Insa Sadio
(74) *Attorney, Agent, or Firm* — Harness, Dickey & Pierce, P.L.C.

(57) ABSTRACT

A pixel compensating circuit comprises an organic light-emitting diode (OLED), a first transistor, a compensating transistor, a storage capacitor, a second transistor, a third transistor, and a seventh transistor. If a present-stage scan signal is at a low voltage potential, the second transistor is turned on, the gate of the first transistor and the drain of the first transistor are short-circuited. A data signal is transmitted to a source of the first transistor after the third transistor is turned on. A third reference voltage is transmitted to the source of the first transistor after the seventh transistor is turned on. An aging phenomenon and the uniformity of the driving transistor are improved.

13 Claims, 6 Drawing Sheets

(56) References Cited

U.S. PATENT DOCUMENTS

| | | | | |
|---|---|---|---|---|
| 2015/0371587 | A1 | 12/2015 | Chen et al. | |
| 2017/0116918 | A1* | 4/2017 | Dong | G09G 3/20 |

FOREIGN PATENT DOCUMENTS

| | | | |
|---|---|---|---|
| CN | 104658470 | A | 5/2015 |
| CN | 107464525 | A | 12/2017 |
| CN | 107993612 | A | 5/2018 |

* cited by examiner

PIXEL COMPENSATING CIRCUIT AND PIXEL COMPENSATING METHOD

FIELD OF INVENTION

The present disclosure relates to a display technology field, particularly relates to a pixel compensating circuit of a pixel driving circuit.

BACKGROUND OF INVENTION

Organic light-emitting diode (OLED) displays become a key technology in development of the display field due to their advantages, such as wide color gamut, high contrast, high brightness, fast response times, low power consumption, and flexibility. In comparison with thin film transistor (TFT) displays, OLED displays are more suitable for large sized, thin, flexible, transparent, and double-sided displays. Especially, active-matrix organic light-emitting diodes (AMOLEDs) have more advantages of being thinner in thickness than general thin film transistors. Thus, AMOLEDs have become the key technology for organic light-emitting diode applications.

As shown in FIG. 1, a basic driving circuit 10 for driving the AMOLED is composed of two thin film transistors (T1 and T2) and one storage capacitor Cst. The thin film transistor T1 is a switching transistor, and a gate of the thin film transistor T1 is connected to a signal SCAN, and a source of the thin film transistor T1 is connected the data signal Data. When the signal SCAN received by the gate is at high voltage potential, the thin film transistor T1 conducts the data signal Data. The thin film transistor T2 is a driving transistor. The electrical current supplied to an organic light-emitting diode OLED is controlled by the thin film transistor T2. A source of the thin film transistor T2 is connected to a voltage source VDD. A gate of the thin film transistor T2 is connected to a drain of the thin film transistor T1. Thus, when the thin film transistor T1 is turned on for conducting the data signal Data, the thin film transistor T2 is also turned on. As a result, an electrical current IOLED flowing through the organic light-emitting diode OLED is $IOLED=k(Vgs-Vth)^2$, where k is the current amplification coefficient of the thin film transistor T2. The value of k is determined by the characteristics of the thin film transistor T2 itself. Vth is the threshold voltage of the thin film transistor T2. Vgs is the voltage difference between the gate and the source of the thin film transistor T2. Because the threshold voltage of the thin film transistor T2 easily drifts, which makes a driving current of the organic light-emitting diode OLED unstable and affects display quality of the OLED panel. Therefore, a threshold voltage compensating circuit is required to English Translation of reduce affection of threshold voltage drift.

FIG. 2 shows a common 7T1C pixel compensating circuit 20 which is composed of seven transistors T21-T27 and one storage capacitor Cst2. The 7T1C pixel compensating circuit 20 is utilized to compensate the organic light-emitting diode OLED. The first transistor T21 performs as a driving transistor. Gates of the second transistor T22, the third transistor T23, and the seventh transistor T27 are connected to the scan signal SCAN(n) of a present stage. A gate of the fourth transistor T24 is connected to the scan signal SCAN(n−1) of the previous stage. A source of the fourth transistor T24 is connected to a source of the second transistor T22. A drain of the fourth transistor T24 is connected to a source of the seventh transistor T27 and a low voltage potential Vi.

Please refer to FIG. 3. FIG. 3 is a sequence diagram of the 7T1C pixel compensating circuit 20 in FIG. 2. The performance of the 7T1C pixel compensating circuit 20 can be divided into a reset stage S1, a compensating stage S2, and an illumination stage S3. In the reset stage S1, the scan signal SCAN(n−1) of the previous stage is at a low voltage potential, and the scan signal SCAN(n) of the present stage and an illuminating signal EM are at a high voltage potential. Therefore, the fourth transistor T24 is turned on and the gate of the first transistor T21 is reset to a low voltage potential Vi.

In the voltage compensating stage S2, the illuminating signal EM is also at the high voltage potential, and the scanning signal SCAN(n−1) of the previous stage changes to a high voltage potential. The scanning signal SCAN(n) of the present stage changes to a low voltage potential. Therefore, the third transistor T23 is turned on to so that the source of the first transistor T21 receives the data signal Data. In the meanwhile, the first transistor T21 performs as a diode because the gate and the drain of the first transistor T21 are short-circuited. Therefore, after the source of the first transistor T21 receives the data signal Data, the gate of the first transistor T21 is charged to a first voltage potential Vdata-Vth. Vdata is the voltage potential of the data signal Data and Vth is the threshold voltage of the first transistor T21. That is, the voltage potential of the gate of the first transistor T21 is equal to a voltage difference between the data signal Data and the threshold voltage of the first transistor T21. At the same time, the second transistor T22 and the seventh transistor T27 also receive the scanning signal SCAN(n) of the present stage which is at low voltage potential. Thus, the seventh transistor T27 is turned on to reset an anode of the organic light-emitting diode OLED to the low voltage potential Vi.

In the illumination stage S3, the illuminating signal EM is at a low voltage potential, and the scanning signal SCAN (n−1) of the previous stage and the scanning signal SCAN (n) of the present stage are both at high voltage potentials. Thus, the second transistor T22, the third transistor T23, the fourth transistor T24, and the seventh transistor T27 are turned off. A voltage source VDD is transmitted to the anode of the organic light-emitting diode OLED through the first transistor T21 and the fifth transistor T25. At this moment, electrical current IOLED passing through the organic light-emitting diode OLED is:

$$I_{OLED_2}=k(VDD-(V\text{data}-|V\text{th}|)-|V\text{th}|)^2=k(VDD-V\text{data})$$

Although the electrical current for driving the organic light emitting diode OLED is irrelevant to the threshold voltage Vth of the first transistor T21, hence the problem of poor display quality caused by the transistor threshold voltage drift of the driving transistor can be avoided. However, the above-mentioned 7T1C pixel compensating circuit still has problems of irregular voltages between threshold voltage and the discharging region. For example, if a display grayscale of the pixel display electrode is zero, there is still electrical current flowing through the driving transistor which makes the organic light emitting diode to illuminate. Therefore, electrical current may leak when a display grayscale of pixels is at low level which causes unlikeness of a displayed grayscale to a desired grayscale and causes poor contrast of the display panel.

Therefore, a pixel compensating circuit is needed to solve the problem of the electrical current leakage and poor contrast that happens in a low display grayscale.

SUMMARY OF INVENTION

The present disclosure provides a pixel compensating circuit comprises an organic light-emitting diode (OLED), a first transistor, a compensating transistor, a storage capacitor, a second transistor, a third transistor, and a seventh transistor. The OLED comprising a cathode connected to a first reference voltage. A source of the first transistor is connected to a high voltage and connected a data signal, and a drain of the first transistor is connected to an anode of the OLED. A source of the compensating transistor and a gate of the compensating transistor are connected to a second reference voltage. A drain of the compensating transistor is connected to the drain of the first transistor wherein a voltage potential of the drain of the first transistor is less than or equal to a sum of a voltage potential of the second reference voltage and a threshold voltage of the compensating transistor. The storage capacitor is disposed between the high voltage and a gate of the first transistor. A gate of the second transistor is connected to a present-stage scan signal. A source of the second transistor is connected to the gate of the first transistor. A drain of the second transistor is connected to the drain of the first transistor and the drain of the compensating transistor. A gate of the third transistor is connected to the present-stage scan signal. A source of the third transistor is connected to the data signal. A drain of the third transistor is connected to the source of the first transistor. A gate of the seventh transistor is connected to the present-stage scan signal. If the present-stage scan signal is at a low voltage potential, the second transistor is turned on, the gate of the first transistor and the drain of the first transistor are short-circuited. The data signal is transmitted to the source of the first transistor after the third transistor is turned on. A third reference voltage is transmitted to the source of the first transistor after the seventh transistor is turned on.

In the pixel compensating circuit of the present disclosure, the pixel compensating circuit further comprises a fourth transistor. A gate of the fourth transistor is connected to a former-stage scan signal. A source of the fourth transistor is connected to the gate of the first transistor. A drain of the fourth transistor is connected to the third reference voltage. If the former-stage scan signal is at a low voltage potential, the third reference voltage is transmitted to the gate of the first transistor to reset a voltage potential of the gate of the first transistor to the third reference voltage after the fourth transistor is turned on.

In the pixel compensating circuit of the present disclosure, the pixel compensating circuit further comprises a fifth transistor and a sixth transistor. A gate of the fifth transistor and a gate of the sixth transistor receive an emitting signal. A source of the fifth transistor is connected to the drain of the first transistor. A drain of the fifth transistor is connected to the anode of the OLED. A source of the sixth transistor is connected to the high voltage. A drain of the sixth transistor is connected to the source of the first transistor. If the emitting signal is at a low voltage potential, the high voltage is transmitted to the first transistor to make the OLED illuminate after the sixth transistor is turned on.

The present disclosure further provides a pixel compensating circuit comprises an organic light-emitting diode (OLED), a first transistor, a compensating transistor, a storage capacitor, and a second transistor. The organic light-emitting diode (OLED) comprising a cathode connected to a first reference voltage. A source of the first transistor is connected to a high voltage and connected a data signal. A drain of the first transistor is connected to an anode of the OLED. A source of the compensating transistor and a gate of the compensating transistor are connected to a second reference voltage. A drain of the compensating transistor is connected to the drain of the first transistor. A voltage potential of the drain of the first transistor is less than or equal to a sum of a voltage potential of the second reference voltage and a threshold voltage of the compensating transistor. A storage capacitor disposed between the high voltage and a gate of the first transistor. A second transistor, wherein a gate of the second transistor is connected to a present-stage scan signal, a source of the second transistor is connected to the gate of the first transistor. A drain of the second transistor is connected to the drain of the first transistor and the drain of the compensating transistor. If the present-stage scan signal is at a low voltage potential, after the second transistor is turned on, the gate of the first transistor and the drain of the first transistor are short-circuited.

In the pixel compensating circuit of the present disclosure, the pixel compensating circuit further comprises a third transistor. A gate of the third transistor is connected to the present-stage scan signal. A source of the third transistor is connected to the data signal. A drain of the third transistor is connected to the source of the first transistor. If the present-stage scan signal of the present disclosure is at a low potential voltage, the data signal is transmitted to the source of the first transistor after the third transistor is turned on.

In the pixel compensating circuit of the present disclosure, the pixel compensating circuit further comprises a fourth transistor. A gate of the fourth transistor is connected to a former-stage scan signal. A source of the fourth transistor is connected to the gate of the first transistor. A drain of the fourth transistor is connected a third reference voltage. If the former-stage scan signal is at a low voltage potential, the third reference voltage is transmitted to the gate of the first transistor to reset a voltage potential of the gate of the first transistor to the third reference voltage after the fourth transistor is turned on.

In the pixel compensating circuit of the present disclosure, the pixel compensating circuit further comprises a fifth transistor and a sixth transistor. A gate of the fifth transistor and a gate of the sixth transistor receive an emitting signal. A source of the fifth transistor is connected to the drain of the first transistor. A drain of the fifth transistor is connected to the anode of the OLED. A source of the sixth transistor is connected to the high voltage. A drain of the sixth transistor is connected to the source of the first transistor. If the emitting signal is at a low voltage potential, the high voltage is transmitted to the first transistor to make the OLED illuminate after the sixth transistor is turned on.

In the pixel compensating circuit of the present disclosure, the pixel compensating circuit further comprises a seventh transistor. A gate of the seventh transistor is connected to the present-stage scan signal. If the present-stage scan signal is at a low voltage potential, the third reference voltage is transmitted to the source of the first transistor after the seventh transistor is turned on.

The present disclosure further provides a pixel compensating method comprises: connecting a cathode of an organic light-emitting diode (OLED) to a first reference voltage; connecting a source of a first transistor to a high voltage and a data signal, connecting a drain of the first transistor to an anode of the OLED; connecting a source of a compensating transistor and a gate of the compensating transistor to a second reference voltage, connecting a drain of the compensating transistor to the drain of the first transistor, wherein a voltage potential of the drain of the first transistor is less than or equal to a sum of a voltage potential of the second reference voltage and a threshold voltage of the compensating transistor; disposing a storage capacitor between the high voltage and a gate of the first transistor;

and connecting a gate of a second transistor to a present-stage scan signal, connecting a source of the second transistor to the gate of the first transistor, connecting a drain of the second transistor to the drain of the first transistor and the drain of the compensating transistor. If the present-stage scan signal is at a low voltage potential, the gate of the first transistor and the drain of the first transistor are short-circuited after the second transistor is turned on.

In the pixel compensating method of the present disclosure further comprises connecting a gate of the third transistor to the present-stage scan signal, connecting a source of the third transistor to the data signal, and connecting a drain of the third transistor to the source of the first transistor. If the present-stage scan voltage is at a low voltage potential, the data signal is transmitted to the source of the first transistor after the third transistor is turned on.

In the pixel compensating method of the present disclosure further comprises connecting a gate of a fourth transistor to a former-stage scan signal, a source of the fourth transistor to the gate of the first transistor, and connecting a source of the fourth transistor to a third reference voltage. If the former-stage scan signal is at a low voltage potential, the third reference voltage is transmitted to the gate of the first transistor and a voltage potential of the gate of the first transistor is reset to the third reference voltage.

In the pixel compensating method of the present disclosure further comprises connecting a gate of a fifth transistor and a gate of a sixth transistor to a light-emitting signal, connecting a source of the fifth transistor to the drain of the first transistor, connecting a drain of the fifth transistor to the anode of the OLED, connecting a source of the sixth transistor to the high voltage, and connecting a drain of the sixth transistor to the source of the first transistor. If the light-emitting signal is at a low voltage potential, the high voltage is transmitting to the source of the first transistor to make the OLED illuminating after the sixth transistor is turned on.

In the pixel compensating method of the present disclosure further comprises connecting a gate of a seventh transistor to the present-stage scan signal. If the present-stage scan signal is at a low voltage potential, the third reference voltage is transmitted to the source of the first transistor after the seventh transistor is turned on.

The advantage of the present disclosure is that the pixel compensating circuit and the pixel compensating method of the present disclosure can improve the aging phenomenon of the driving transistor and improve the uniformity of the driving transistor.

DETAILED DESCRIPTION OF PREFERRED EMBODIMENTS

The display panel and the display device provided by the present disclosure will be described in detail below with reference to the accompanying drawings. The longitudinal, lateral, upper, lower, left, right, front, and rear aspects of the detailed description are merely for convenience of describing the relative relationship between the components rather than limitations of embodiments of the present disclosure. It is apparent that the described embodiments only exemplify a part of the embodiments of the disclosure. All other embodiments which can be obtained by a person of ordinary skill in the art based on the embodiments of the present disclosure without creative efforts fall within the scope of the present disclosure.

The display panel and the display device provided by the present disclosure will be described in detail below with reference to the accompanying drawings. The longitudinal, lateral, upper, lower, left, right, front, and rear aspects of the detailed description are merely for convenience of describing the relative relationship between the components rather than limitations of the embodiments of the present disclosure. It is obvious that the described embodiments are only a part, not all, of the embodiments of the invention. All other embodiments obtained by a person of ordinary skill in the art based on the embodiments of the present disclosure without creative efforts are within the scope of the present disclosure.

Figure 4:
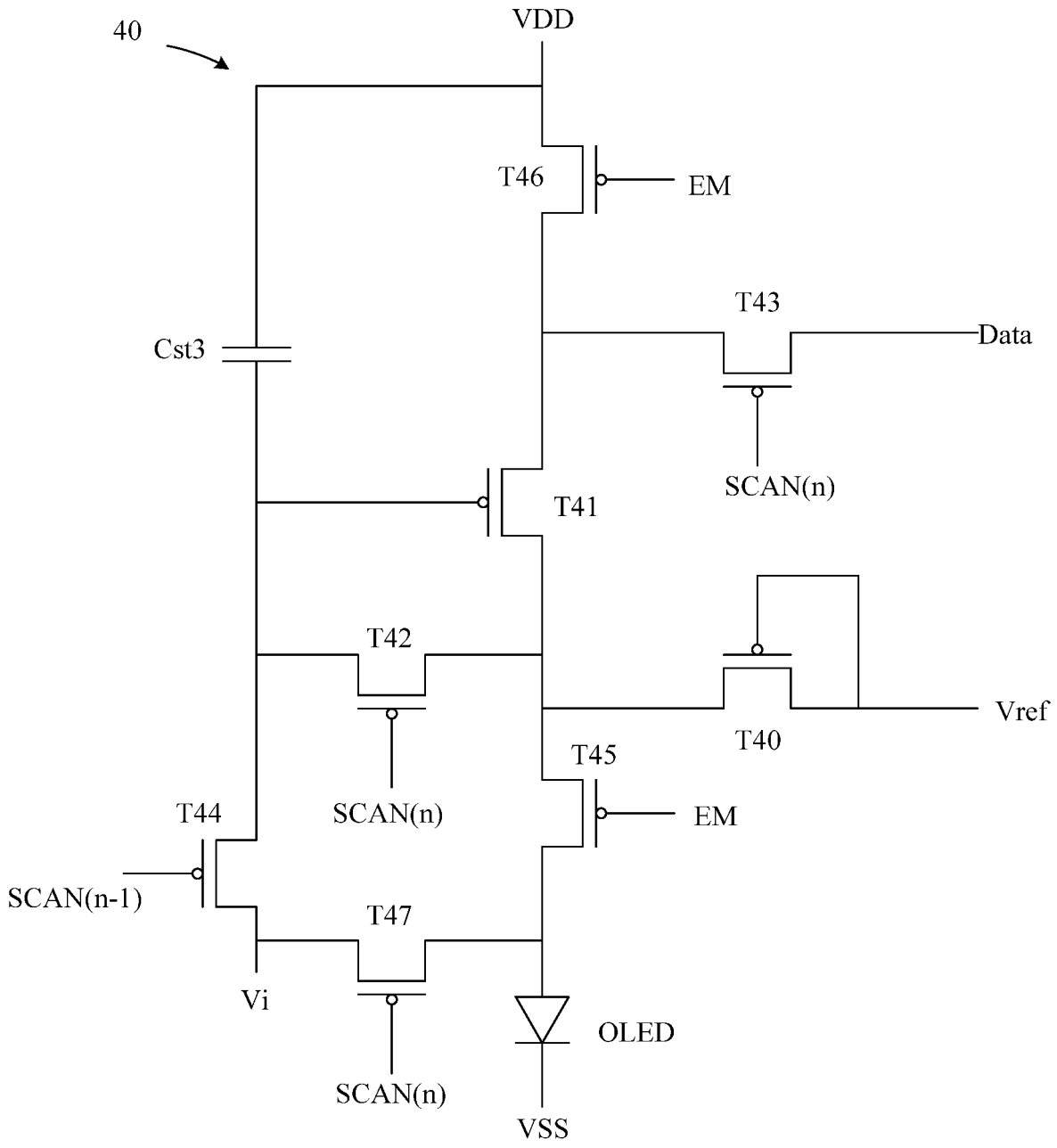
FIG. 4 illustrates a 7T1C pixel compensating circuit of the present disclosure.

Please refer to FIG. 4. FIG. 4 is a 7T1C pixel compensating circuit of the present disclosure. The pixel compensating circuit 40 includes a compensating transistor T40, seven transistors T41-T47, a storage capacitor Cst3, and an organic light-emitting diode (OLED). The first transistor T41 performs as a driving transistor.

In the pixel compensating circuit 40 of the present disclosure, a source and gate of the compensating transistor T40 are connected to a reference voltage Vref and a drain of the compensating transistor T40 is connected to a drain of the first transistor T41. A source of the first transistor T41 is connected to a voltage VDD through the sixth transistor T46, in the meanwhile, the source of the first transistor T41 is connected to a data signal Data through the third transistor T43. A gate of the first transistor T41 is connected to the high voltage potential VDD through the storage capacitor Cst3. The drain of the first transistor T41 is connected to a reference voltage VSS through the fifth transistor T45.

Gates of the second transistor T42, the third transistor T43, and the seventh transistor T47 are connected to a scan signal SCAN(n) of the present stage. A source of the third transistor T43 is connected to a data signal Data. A gate of the fourth transistor T44 is connected receives a scan signal SCAN(n−1) of the previous stage. A source and a drain of the second transistor T42 are respectively connected to the gate and the drain of the first transistor T41 so that if the scan signal SCAN(n) of the present stage is at a low voltage potential, the first transistor T41 performs as a diode because the gate and the drain of the first transistor T41 are short-circuited. The source and a drain of the third transistor T43 are respectively connected to the data signal Data and the source of the first transistor T41 so that if the scan signal SCAN(n) of the present stage is at low voltage potential, the data signal Data is transmitted to the source of the first transistor. T41.

A source of the fourth transistor T44 is connected to the source of the second transistor T42. A drain of the fourth transistor T44 is connected to the source of a seventh transistor T47 and the low voltage potential Vi. Therefore, in a reset stage, when the scan signal SCAN(n−1) of the previous stage is at low voltage potential, the gate of the first transistor T41 is reset to the low voltage potential Vi and an anode of the organic light-emitting diode OLED is connected to the low voltage potential Vi. Therefore, in the reset stage, the organic light-emitting diode OLED does not illuminate. Different from the present technology, because a source and a gate of the compensating transistor T40 are both connected to a reference voltage Vref. In a preferred embodiment of the present disclosure, the reference voltage Vref is set between −20V and −30V. The low voltage potential Vi is set between 6V and 10V. Therefore, a voltage potential of the drain of the first transistor T41 is approximately equal to or smaller than Vref+|Vth0|. Vth0 is a threshold voltage of the compensating transistor T40. Therefore, voltage difference between the gate and the drain of the first transistor T41 exceeds 30V.

Gates of the fifth transistor T45 and the sixth transistor T46 are connected to a light emitting signal EM. If the light emitting signal EM is at a low voltage potential, the high voltage potential VDD is transmitted to the anode of the organic light-emitting diode through the sixth transistor T46, the first transistor T41 and the fifth transistor T45 to make the organic light-emitting diode OLED illuminate. The voltage difference between the gate and the drain of the first transistor T41 will exceed 30V by utilizing the pixel compensating circuit 40 of the present disclosure. As a result, the first transistor T41 will not turn on due to the small voltage difference between the gate and the drain of the driving transistor (i.e., the first transistor T41) even a display grayscale is low. The organic light emitting diode (OLED) will surely not illuminate even the light emitting signal EM is at a high voltage potential.

Figure 1:
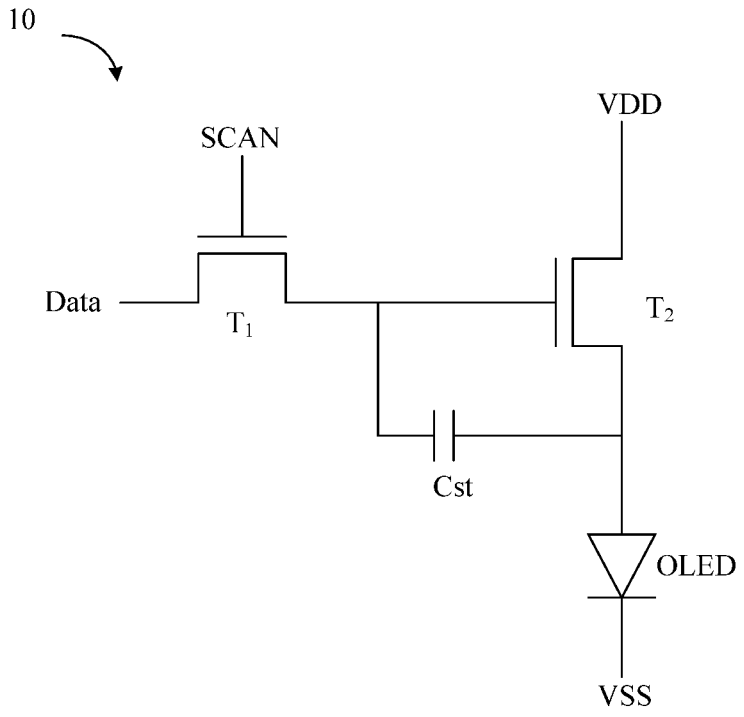
FIG. 1 illustrates a pixel driving circuit.
Figure 2:
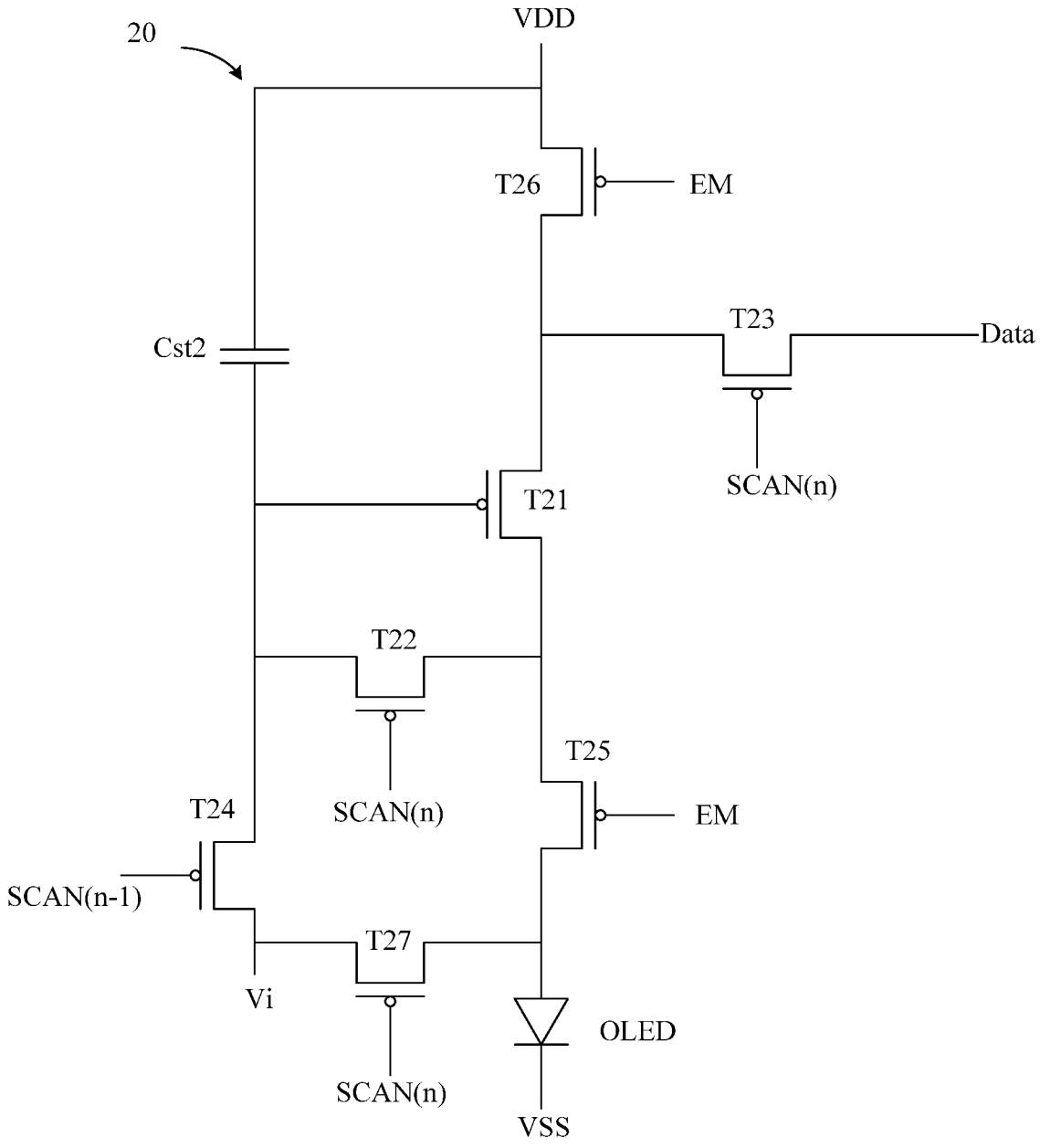
FIG. 2 illustrates a present 7T1C pixel compensating circuit.
Figure 3:
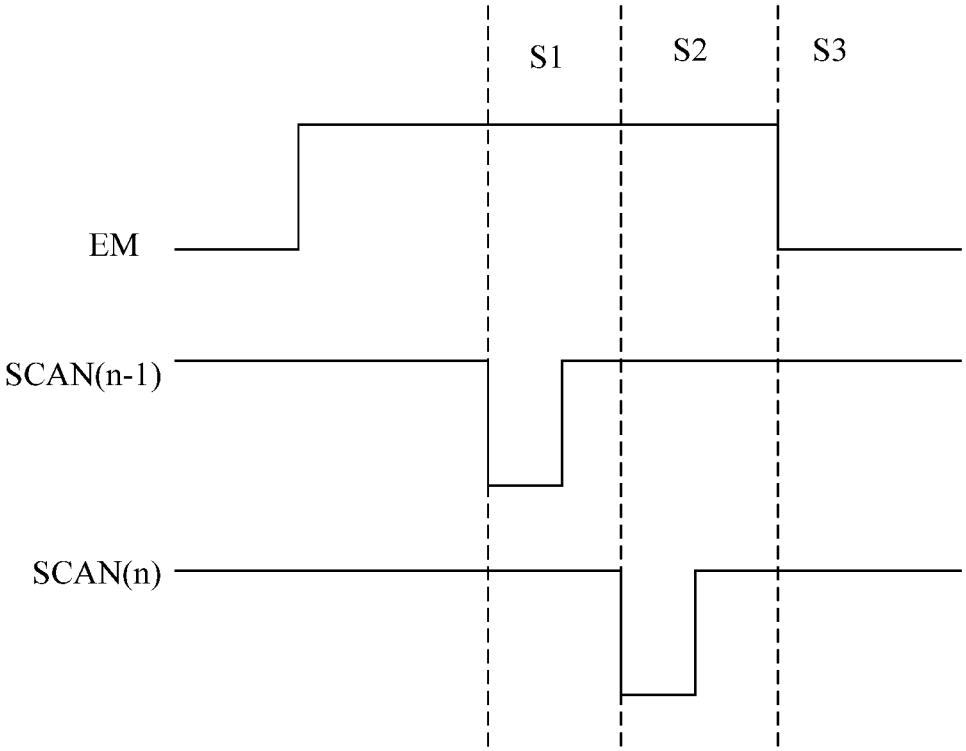
FIG. 3 illustrates a sequence diagram of the present 7T1C pixel compensating circuit.
Figure 5:
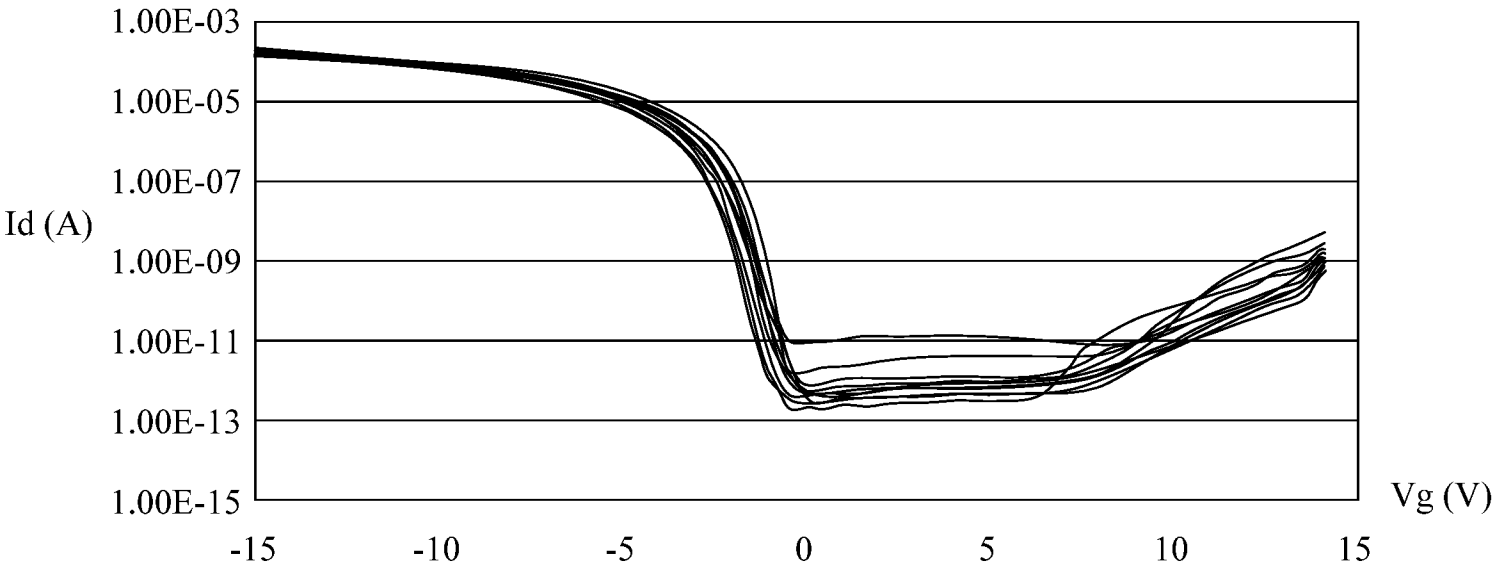
FIG. 5 illustrates a test curve of a drain and a gate of a driving transistor of the present 7T1C pixel compensating circuit.
Figure 6:
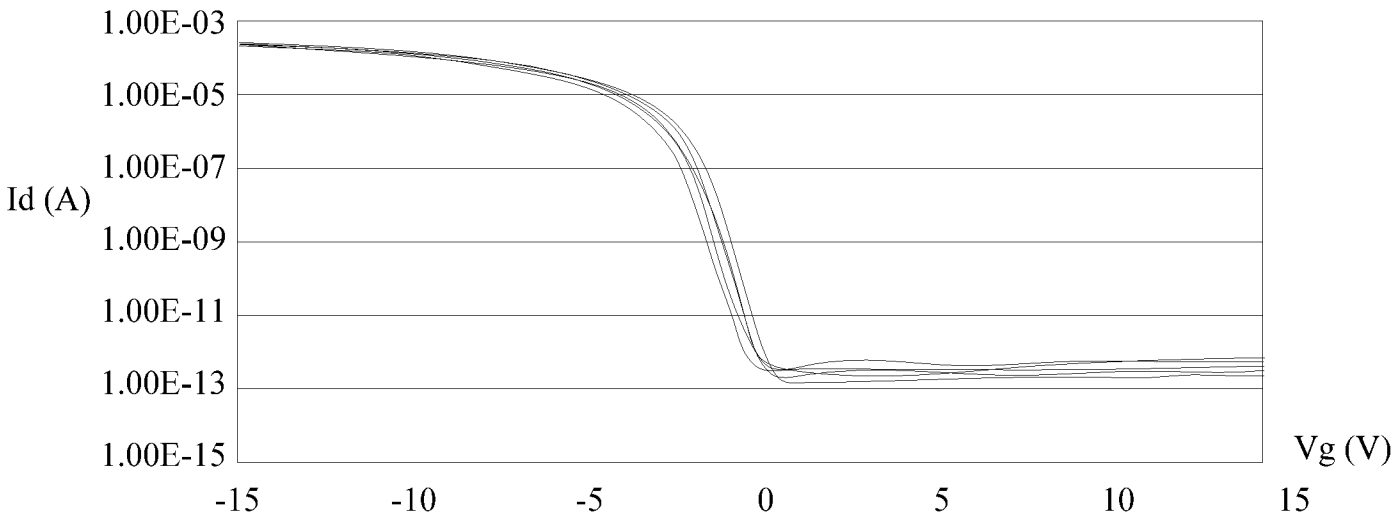
FIG. 6 illustrates a test curve of a drain and a gate of a driving transistor of the 7T1C pixel compensating circuit of the present disclosure.

FIG. 5 illustrates a test curves of the drain and the gate of the driving transistor T21 in the 7T1C pixel compensating circuit of the present (i.e., as shown in FIG. 2) technology. FIG. 6 illustrate a test curves of the drain and the gate of the driving transistor T41 in the 7T1C pixel compensating circuit of the present disclosure (i.e., as shown in FIG. 4). The horizontal axis of FIG. 5 and FIG. 6 represents the gate voltage of the driving transistor while the vertical axis represents the leaking electrical current of the driving transistor. As shown in FIG. 5, in the conventional 7T1C pixel compensating circuit, the driving transistor T21 has poor uniformity due to aging of the transistor. Then, please refer to FIG. 6, by utilizing the 7T1C pixel compensating circuit of the present disclosure, the gate of the driving transistor T41 receives the low voltage potential Vi and the drain of the driving transistor T41 is connected to the compensating transistor T40 for receiving a voltage being equal to or smaller than Vref+|Vth0|. The voltage difference between the gate and the drain of the driving transistor T41 exceeds 30V which can effectively improve the aging of transistors and improve the uniformity of the driving transistor.

The above description is only a preferred embodiment of the present disclosure. It should be noted that a skilled person in the art can also make improvements and modifications without departing from the principles of the present disclosure should be considered as the scope of protection of the present disclosure.

What we claim is:

1. A pixel compensating circuit, comprising:

an organic light-emitting diode (OLED) comprising a cathode connected to a first reference voltage;

a first transistor, wherein a source of the first transistor is connected to a high voltage and connected a data signal, and a drain of the first transistor is connected to an anode of the OLED;

a compensating transistor, wherein a source of the compensating transistor and a gate of the compensating transistor are connected to a second reference voltage, and a drain of the compensating transistor is connected to the drain of the first transistor wherein a voltage potential of the drain of the first transistor is less than or equal to a sum of a voltage potential of the second reference voltage and a threshold voltage of the compensating transistor;

a storage capacitor disposed between the high voltage and a gate of the first transistor;

a second transistor, wherein a gate of the second transistor is connected to a present-stage scan signal, a source of the second transistor is connected to the gate of the first transistor, and a drain of the second transistor is connected to the drain of the first transistor and the drain of the compensating transistor;

a third transistor, wherein a gate of the third transistor is connected to the present-stage scan signal, a source of the third transistor is connected to the data signal, and a drain of the third transistor is connected to the source of the first transistor; and a seventh transistor, wherein a gate of the seventh transistor is connected to the present-stage scan signal;

wherein if the present-stage scan signal is at a low voltage potential, the second transistor is turned on, the gate of the first transistor and the drain of the first transistor are short-circuited, the data signal is transmitted to the source of the first transistor after the third transistor is turned on, and a third reference voltage is transmitted to the source of the first transistor after the seventh transistor is turned on.

2. The pixel compensating circuit according to claim 1, wherein the pixel compensating circuit further comprises:

a fourth transistor, wherein a gate of the fourth transistor is connected to a former-stage scan signal, a source of the fourth transistor is connected to the gate of the first transistor, and a drain of the fourth transistor is connected to the third reference voltage;

if the former-stage scan signal is at a low voltage potential, the third reference voltage is transmitted to the gate of the first transistor to reset a voltage potential of the gate of the first transistor to the third reference voltage after the fourth transistor is turned on.

3. The pixel compensating circuit according to claim 1, wherein the pixel compensating circuit further comprises a fifth transistor and a sixth transistor, wherein a gate of the fifth transistor and a gate of the sixth transistor receive an emitting signal, a source of the fifth transistor is connected to the drain of the first transistor, a drain of the fifth transistor is connected to the anode of the OLED, a source of the sixth transistor is connected to the high voltage, and a drain of the sixth transistor is connected to the source of the first transistor;

if the emitting signal is at a low voltage potential, the high voltage is transmitted to the first transistor to make the OLED illuminate after the sixth transistor is turned on.

4. A pixel compensating circuit, comprising:

an organic light-emitting diode (OLED) comprising a cathode connected to a first reference voltage;

a first transistor, wherein a source of the first transistor is connected to a high voltage and connected a data signal, a drain of the first transistor is connected to an anode of the OLED;

a compensating transistor, wherein a source of the compensating transistor and a gate of the compensating transistor are connected to a second reference voltage, a drain of the compensating transistor is connected to the drain of the first transistor, wherein a voltage potential of the drain of the first transistor is less than or equal to a sum of a voltage potential of the second reference voltage and a threshold voltage of the compensating transistor;

a storage capacitor disposed between the high voltage and a gate of the first transistor;

a second transistor, wherein a gate of the second transistor is connected to a present-stage scan signal, a source of the second transistor is connected to the gate of the first transistor, a drain of the second transistor is connected to the drain of the first transistor and the drain of the compensating transistor;

if the present-stage scan signal is at a low voltage potential, after the second transistor is turned on, the gate of the first transistor and the drain of the first transistor are short-circuited.

5. The pixel compensating circuit according to claim 4, wherein the pixel compensating circuit further comprises a third transistor, wherein a gate of the third transistor is connected to the present-stage scan signal, a source of the third transistor is connected to the data signal, a drain of the third transistor is connected to the source of the first transistor;

if the present-stage scan signal of the present disclosure is at a low potential voltage, the data signal is transmitted to the source of the first transistor after the third transistor is turned on.

6. The pixel compensating circuit according to claim 4, wherein the pixel compensating circuit further comprises a fourth transistor, a gate of the fourth transistor is connected to a former-stage scan signal, a source of the fourth transistor is connected to the gate of the first transistor, a drain of the fourth transistor is connected a third reference voltage;

if the former-stage scan signal is at a low voltage potential, the third reference voltage is transmitted to the gate of the first transistor to reset a voltage potential of the gate of the first transistor to the third reference voltage after the fourth transistor is turned on.

7. The pixel compensating circuit according to claim 4, wherein the pixel compensating circuit further comprises a fifth transistor and a sixth transistor, wherein a gate of the fifth transistor and a gate of the sixth transistor receive an emitting signal, a source of the fifth transistor is connected to the drain of the first transistor, a drain of the fifth transistor is connected to the anode of the OLED, a source of the sixth transistor is connected to the high voltage, a drain of the sixth transistor is connected to the source of the first transistor;

if the emitting signal is at a low voltage potential, the high voltage is transmitted to the first transistor to make the OLED illuminate after the sixth transistor is turned on.

8. The pixel compensating circuit according to claim 6, wherein the pixel compensating circuit further comprises a seventh transistor, wherein a gate of the seventh transistor is connected to the present-stage scan signal;

if the present-stage scan signal is at a low voltage potential, the third reference voltage is transmitted to the source of the first transistor after the seventh transistor is turned on.

9. A pixel compensating method, comprising:

connecting a cathode of an organic light-emitting diode (OLED) to a first reference voltage;

connecting a source of a first transistor to a high voltage and a data signal, connecting a drain of the first transistor to an anode of the OLED;

connecting a source of a compensating transistor and a gate of the compensating transistor to a second reference voltage, connecting a drain of the compensating transistor to the drain of the first transistor, wherein a voltage potential of the drain of the first transistor is less than or equal to a sum of a voltage potential of the second reference voltage and a threshold voltage of the compensating transistor;

disposing a storage capacitor between the high voltage and a gate of the first transistor; and connecting a gate of a second transistor to a present-stage scan signal, connecting a source of the second transistor to the gate of the first transistor, connecting a drain of the second transistor to the drain of the first transistor and the drain of the compensating transistor;

if the present-stage scan signal is at a low voltage potential, the gate of the first transistor and the drain of the first transistor are short-circuited after the second transistor is turned on.

10. The pixel compensating method according to claim 9 further comprises connecting a gate of the third transistor to the present-stage scan signal, connecting a source of the third transistor to the data signal, and connecting a drain of the third transistor to the source of the first transistor;

if the present-stage scan voltage is at a low voltage potential, the data signal is transmitted to the source of the first transistor after the third transistor is turned on.

11. The pixel compensating method according to claim 9 further comprises connecting a gate of a fourth transistor to a former-stage scan signal, a source of the fourth transistor to the gate of the first transistor, and connecting a source of the fourth transistor to a third reference voltage;

if the former-stage scan signal is at a low voltage potential, the third reference voltage is transmitted to the gate of the first transistor and a voltage potential of the gate of the first transistor is reset to the third reference voltage.

12. The pixel compensating method according to claim 9 further comprises connecting a gate of a fifth transistor and a gate of a sixth transistor to a light-emitting signal, connecting a source of the fifth transistor to the drain of the first transistor, connecting a drain of the fifth transistor to the anode of the OLED, connecting a source of the sixth transistor to the high voltage, and connecting a drain of the sixth transistor to the source of the first transistor;

if the light-emitting signal is at a low voltage potential, the high voltage is transmitting to the source of the first transistor to make the OLED illuminating after the sixth transistor is turned on.

13. The pixel compensating method according to claim 12 further comprises connecting a gate of a seventh transistor to the present-stage scan signal, if the present-stage scan signal is at a low voltage potential, the third reference voltage is transmitted to the source of the first transistor after the seventh transistor is turned on.

* * * * *